US007584584B2

(12) United States Patent
Fennell, Jr.

(10) Patent No.: US 7,584,584 B2
(45) Date of Patent: Sep. 8, 2009

(54) REUSABLE MODULAR BLOCK WALL ASSEMBLY SYSTEM

(76) Inventor: Harry C. Fennell, Jr., P.O. Box 87, North Thetford, VT (US) 05054

( * ) Notice: Subject to any disclaimer, the term of this patent is extended or adjusted under 35 U.S.C. 154(b) by 100 days.

(21) Appl. No.: 11/697,879

(22) Filed: Apr. 9, 2007

(65) Prior Publication Data

US 2008/0245005 A1 Oct. 9, 2008

(51) Int. Cl.

| | |
|---|---|
| ***E04B 1/74*** | (2006.01) |
| ***E04B 1/02*** | (2006.01) |
| ***E04B 5/04*** | (2006.01) |
| ***E04B 5/48*** | (2006.01) |
| ***E04C 1/39*** | (2006.01) |
| ***E04C 3/30*** | (2006.01) |
| ***E04C 2/04*** | (2006.01) |

(52) U.S. Cl. ..... 52/607; 52/405.3; 52/505; 52/565; 52/601; 52/606

(58) Field of Classification Search ..... 52/405.3, 52/503, 504, 505, 565, 601, 606, 607
See application file for complete search history.

(56) References Cited

U.S. PATENT DOCUMENTS

| | | | | |
|---|---|---|---|---|
| 676,803 | A * | 6/1901 | Shaw | 52/590.1 |
| 1,785,499 | A * | 12/1930 | Sayers | 52/505 |
| 4,075,808 | A | 2/1978 | Pearlman | |
| 4,110,949 | A | 9/1978 | Cambiuzzi et al. | |
| 4,228,628 | A | 10/1980 | Schlomann | |
| 4,277,925 | A | 7/1981 | Kinser | |
| 4,288,960 | A | 9/1981 | Auras | |
| 4,473,985 | A * | 10/1984 | Hunt | 52/592.6 |
| 4,503,648 | A | 3/1985 | Mahaffey | |
| 4,510,725 | A | 4/1985 | Wilson | |
| 4,731,279 | A | 3/1988 | Isshiki | |
| 4,748,782 | A | 6/1988 | Johnson et al. | |
| 4,909,012 | A | 3/1990 | Thompson, Jr. et al. | |
| 5,177,924 | A | 1/1993 | Kakuk | |
| 5,241,795 | A | 9/1993 | Giroux et al. | |
| 5,277,008 | A | 1/1994 | Saulez | |
| 5,379,565 | A | 1/1995 | Vienne | |
| 5,485,703 | A | 1/1996 | Nordahl | |
| 5,513,475 | A | 5/1996 | Schaaf et al. | |
| 5,528,874 | A | 6/1996 | Schmid | |
| 5,575,128 | A | 11/1996 | Haener | |

(Continued)

FOREIGN PATENT DOCUMENTS

| | | |
|---|---|---|
| WO | WO 0077316 A1 | 12/2000 |

(Continued)

*Primary Examiner*—Brian E. Glessner
*Assistant Examiner*—Branon C Painter
(74) *Attorney, Agent, or Firm*—Robert R. Deleault, Esq.; Mesmer & Deleault, PLLC

(57) ABSTRACT

A reusable modular block system includes a lightweight structural block having a top, a bottom, a first block end, a second block end, an insulating core, an inside facing and an outside facing wherein the structural block is configured to create internal vertical and horizontal raceways between adjacent blocks, a gasketing system connected to the structural block along a portion of the periphery of the structural block, and a fastening system within and that extends horizontally and vertically through the insulating core where the structural block, the gasketing system and the fastening system form a single, integral block component.

18 Claims, 5 Drawing Sheets

U.S. PATENT DOCUMENTS 5,685,119 A * 11/1997 Zschoppe ..... 52/592.5
5,699,640 A 12/1997 Bourgeois et al.
5,711,130 A 1/1998 Shatley
5,771,654 A 6/1998 Moore et al.
5,822,939 A 10/1998 Haener
5,826,394 A 10/1998 Barton, Jr. et al.
5,992,102 A 11/1999 Ozawa
5,992,119 A 11/1999 Rokhlin
6,065,265 A 5/2000 Stenekes
6,164,035 A 12/2000 Roberts
6,226,951 B1 * 5/2001 Azar ..... 52/604
6,405,509 B1 6/2002 Razl
6,453,625 B1 9/2002 Corbett
6,537,682 B2 * 3/2003 Colligan ..... 428/593
6,543,969 B1 4/2003 Adam
6,557,316 B2 5/2003 Van Der Jeijden
6,588,168 B2 7/2003 Waters
6,591,569 B2 7/2003 Azar
6,691,485 B1 2/2004 Prokofyev
6,705,057 B2 3/2004 Smyer, III
6,758,020 B2 * 7/2004 Cerrato ..... 52/606
6,796,098 B2 9/2004 Hampton
6,848,228 B1 2/2005 Williams
6,907,704 B2 6/2005 Abang Ali et al.
D527,467 S 8/2006 Telford
2002/0038529 A1 4/2002 Nelson
2004/0194406 A1 10/2004 Park
2005/0262801 A1 12/2005 Landwehr et al.
2006/0147681 A1 7/2006 Dubey

FOREIGN PATENT DOCUMENTS

WO WO 0238518 A1 5/2002
WO WO 2006073540 A2 7/2006

* cited by examiner

REUSABLE MODULAR BLOCK WALL ASSEMBLY SYSTEM

BACKGROUND OF THE INVENTION

1. Field of the Invention

The present invention relates generally to a building system. Particularly, the present invention relates to a building system with individual building components connected together.

2. Description of the Prior Art

The art of constructing buildings or enclosures to protect people and things from the weather has been done throughout the ages. Building systems and methods have been devised to accomplish the assembly of buildings in a more orderly and predetermined fashion using a variety of building materials.

The most commonly used method in both residential and commercial wall construction is known as stick-built construction. Stick-built construction is relatively slow, requiring numerous types of materials and steps to complete the assembly process. It is relatively low technology and typically does not require special or large equipment for installation. A typical wall system in a commercial assembly requires at least four and as many as seven trades. Stick-built construction is seldom successful in achieving high-performance structures as the high number of parts, steps, and trades generally leads to problems with air barrier and insulation performance. Further, stick-built construction is never reusable.

Another method used is known as prefabricated and/or panelized construction. In this method, some of the construction steps of the stick-built method are performed in a factory and then the components are shipped to the site in the form of larger, pre-assembled units. Prefabricated and/or panelized construction is typically more expensive than stick-built construction and requires heavy equipment and specialized trades for installation. Panelized construction is seldom used successfully to achieve high-performance structures due to the difficulty in achieving high-performance gasketing or sealing systems as well as the difficulty in achieving good building envelope continuity at transitions between these systems and other portions of the construction such as the roof, the foundation, the window and door systems, etc. Prefabricated and/or panelized construction is rarely reusable.

Yet another method used is known as modular block construction. Modular block construction uses smaller prefabricated modular units that incorporate a variety of interlocking modular shapes and sizes. Modular block systems on the market are typically systems where the blocks are forms for casting poured-in-place concrete. These systems require heavy equipment and specialized trades to install them. Others are not insulated or require finishes to be added and are not weather tight. None of these "block" systems are complete wall system assemblies. Most of these block systems are not reusable at all or, at least, not in their original form. Examples of some of these block systems are disclosed.

U.S. Pat. No. 4,731,279 (1988, Isshiki) discloses an assembly block formed from a poly-olefin foam. The block has a body that has a pair of opposite surfaces of which one is provided with a plurality of regularly spaced apart holes, while the other surface is provided with a plurality of regularly spaced apart projections of which each can be fitted into one of the holes of another block. At least one bore extends through the body between the opposite surfaces for receiving a reinforcing bar. The blocks are lightweight and used for assembling a piece of furniture or a part of a building such as a table, stool, gate, or arch.

U.S. Pat. No. 5,699,640 (1997, Bourgeois et al.) discloses stackable and connectable foam building blocks. The building blocks include pairs of parallel side walls and multiple transverse members extending between the side walls at regular intervals. Each end wall has a U-shaped cutout section at its top to allow concrete flow between cavities of adjacent blocks and for supporting rebars. The upper edge of the end wall defining the lower part of the U-shaped section gradually increases from the outer surface to the inner surface of the end wall to form a downward and inward sloping surface for the lower part of the U-shaped section. Each transverse member includes a pair of structures substantially identical to the end walls. The two structures are positioned back-to-back, such that each cutout surface slopes inward and downward from the middle of the transverse member towards the adjacent cavity and a ridge is formed where the two sloping surfaces meet. The inner surfaces of the side walls, transverse members and end walls defining the cavities have a substantially vertical upper portion, and inward and downward sloping intermediate portion and outward and downward sloping bottom portion. The inner surfaces of the side walls are curved where the side walls meet the transverse members and the end walls, giving the cavities a generally octagonal shape. Stacking members on the upper and lower edges of the side walls, and connectors on outer surfaces of end walls connect blocks in horizontal rows.

U.S. Pat. No. 6,164,035 (2000, Roberts) discloses a reinforced foam block wall. The foam wall assembly includes vertical passageways that guide wall support elements. The wall assembly has a lower end and an upper support element that are affixed to the wall support elements. The foam wall has inner and outer thermal barriers that thermally isolate the wall support elements.

U.S. Pat. No. 5,992,102 (1999, Ozawa) discloses a cellular resin block and structural unit for an exterior structure using such block. The cellular block is integrally molded from suitable foamable resin and includes vertical grooves at the transversely opposite extremities, a vertical bar passage at the transversely middle and mortar wells extending on the upper end of the block. Brick is adhesively laid on the surface of the block using elastic mortar to form a structural unit.

U.S. Pat. No. 6,557,316 (2003, Van Der Heijden) discloses a building system having a plurality of building elements and connecting mechanisms where each of the building elements has an upper and a lower surface which are substantially parallel to each other and at least one opening extending from the upper surface to the lower surface, and each building element is adapted for alignment with respect to an opening in another building element. Each connecting mechanism is dimensioned to fit within and extend through an opening in a building element and interconnect a plurality of building elements and deformation members. Deformation members are positioned between a lower surface of a building element and a connecting mechanism of another building element, and deformable by a predetermined force to induce a stress in the connecting mechanism of a building element such that it is pressed with a second predetermined force to another building element.

Each of the disclosed prior art devices has one or more of the following shortcomings on the way to creating a complete, sustainable building envelope. These include, but are not limited to, a lack of gasketing between the blocks, a lack of a water shedding profile, a lack of a stand-alone integral structure, no integral raceways, no integral fastening system, and most are not reusable at all or, at least, not in their original form.

Therefore, what is needed is a reusable structural block that easily forms a complete building enclosure and can be used in place of stick-built construction. What is further needed is a reusable modular block wall system that includes an integral fastening system. What is also needed is a reusable modular block system that is lightweight, easy to handle and assemble with a minimal number of tools and specialized training.

SUMMARY OF THE INVENTION

Overview: The modular block system of the present invention is used to create a structural building enclosure wall construction system that provides a reusable product, a high-performance thermal building envelope, flexibility in the installed shape and appearance, an easy interface with accessory building materials, a secure building system, and ease and speed of construction at a reasonable cost. The present invention is completely reusable in its original form, incorporates the means of accommodating usual electrical systems, has superior thermal performance, and performs the structural needs necessary for low-rise buildings or infill curtain wall construction. The reusability characteristics allow for installation, demounting, and reinstallation of the components in their original form without modification.

Design Flexibility: The present invention provides a complete modular wall system that can be assembled to meet most building designs without custom fitting of the parts and is compatible with other common building components (windows, doors, etc.). The modular block system of the present invention provides components in sizes and configurations that allow maximum design flexibility. The component sizes of the structural block system of the present invention are configured to meet common structural building component sizes such as, for example, multiples of one foot (1') (30.38 cm). These suggested building sizes are only exemplary, and it should be understood that other sizes or multiples of other sizes may easily be made and are within the scope of the present invention. In addition to providing a number of structural block configurations to allow virtually unlimited design arrangements, the present invention includes interior and exterior skins/facings that can serve as finishes or receive and support additional surfacing treatments and built-in assemblies. These facings (which, by way of examples, can be stamped or molded "veneers") can be changed to provide different aesthetic "looks." The basic and optional facings also provide code-compliant fire and weather protection for the cellular foam or other insulating core material of the blocks.

Structural System Parts: While one of the goals of the system of the present invention is to have as few different parts as possible to simplify and reduce distribution and storage costs, an adequate number of parts and sizes are necessary to provide a complete and flexible building system. The structural block system includes one or more block configurations such as a horizontal block, a corner block, a sill cap block, a head cap block, a side jamb block, and the like. A line or series of specialized parts may be required for special conditions found in commercial and high-rise curtain wall system applications that are not typically used in residential construction.

Multiple uses: The structural block system of the present invention is also useable in more or less formal situations. One scenario that the system addresses is a do-it-yourself homeowner who wants to add a bedroom to his existing home. The present invention is configured so that the owner can demount the existing blocks where the new room is to be added, buy the additional blocks needed at a local building supply house, take the lightweight blocks home on a trailer or in a pickup truck, and lay up the new walls using a combination of the blocks that were removed and the newly purchased blocks. Another scenario would be use in a disaster relief situation. The basic structural blocks of the present invention could be air dropped to a remote area and the victims could assemble their own shelters. These materials could be reused later in the permanent residences of the victims. At the other end of the spectrum, the structural block system of the present invention is usable as an infill wall system in high-rise commercial steel-framed structures with high-end finishes installed on either or both sides. By stacking and attaching the units to the structure at each floor level, the structural block system of the present invention would provide the same advantages as they provide in low-rise structures.

Ease of Construction, storage, and handling: It is important that each structural block be a stand-alone member that has all components of the system in a single part and can be assembled with a minimum of common hand tools. The present invention provides structure, closure, insulation, and finishes in a simple one-step process. Each individual structural block of the present invention provides the interior and exterior finishes and weather protection. The present invention has a reliable installation procedure. In fact, the block structural configuration makes the installation process easy and intuitive, requiring minimal training and/or installation instructions. Components of the structural block system can be shipped in small vehicles and assembled and demounted without special tools or heavy equipment. The individual structural blocks of the system of the present invention are manageable (i.e. can be handled) by one person. The blocks can be stored outside and remain exposed without protection during the installation process.

Cost effectiveness: The modular block system of the present invention has numerous advantages over other construction methods and systems. The present invention is low tech and provides for efficient construction. Construction is faster than with conventional stick-built construction. The use of the insulation as the structure provides the cost-effective use of higher than current standard insulation values.

Integral electrical raceways: In addition, the structural block system of the present invention provides optional integral raceways for normal in-wall electrical systems. The structure of the modular block is configured to provide both horizontal and vertical internal raceways for wiring in and between adjacent blocks, avoiding routing problems and surface-mounted electrical systems.

Structural Characteristics: The system of the present invention uses the molded insulating core as the entire structure of the component. It doesn't have to be filled with concrete or reinforcing steel or installed with internal framing or other structural elements. It does, however, include optional structure provisions for managing concentrated loads through the use of one or more tubular openings that extend from the top to the bottom of the blocks. The tubular openings are sized to accommodate standard sized construction lumber. The component blocks interlock and are fastened together so that they maintain alignment and transfer structural loads. The system further allows for a staggered stacking pattern to provide additional horizontal strength.

Integral Fastening System: The modular block system of the present invention provides a means of structurally connecting the components to each other. This secure attachment also provides a continuous attachment from the foundation to provide resistance to high wind and earthquake loading. The fastening system also provides structural hold-down points for a roof system so that it can be continuously attached to the foundation to resist wind uplift. The integral fastening system also reinforces the assembled blocks by means of post-tensioning the blocks together. The integral metallic fastening system, when fully installed, runs continuously both vertically and horizontally in a structural spacing pattern that provides adequate security for the inhabitants of the structure. The integral fastening system of the structural blocks of the present invention provides the connection between the blocks and compresses the inter-block gaskets. In addition, the fastening system provides adequate post-tensioning for short spans (one to two blocks). The fastening system in each structural block configuration includes at least one connecting mechanism that extends through the insulating core with a fastener extending end and a fastener receiving end. The extending end of the fastener is configured to connectively attach to the fastener receiving end of an adjacent block. The connecting mechanism may optionally include a securing member that is embedded within the block core to prevent the connecting mechanism from separating from the block, but also provides for free operation of the connecting mechanism. The modular block system includes an integral fastening system for speed and ease of construction and provides a molded structural member that does not violate the continuity of the insulation and structural characteristics of the component.

Complete High-performance Building Envelope: Unlike prior-art systems, the modular block system of the present invention provides the entire thermal envelope (insulation, vapor control, air barrier, structure, etc). The basic block is made of a molded closed-cell foam or other insulating material in a thickness that will provide a level of energy performance many times better than that of normal construction. An assembled wall system using the structural blocks of the present invention provides high-performance thermal insulation along with good sound isolation in to out. The high-performance nature of the present invention (2 to 3 times more energy efficient than other systems) makes it a material of choice for the new "zero energy" market. Each structural component of the system includes a gasket system that provides an airtight envelope to reduce air infiltration to levels much lower than conventional construction. The integral fastening system described above assures a tight seal at all block interfaces. The present invention also provides a completely weather-tight assembly including a water-shedding interlock profile complete with capillary breaks. The structural blocks of the present invention are weather resistant and don't require protection. The structural configuration of the structural blocks of the present invention may also optionally provide for one or more capillary break structures to prevent water retention at their junctions when the structural blocks are assembled.

Sustainability: There is a current industry-wide need to meet sustainability goals. There are several unique characteristics of the modular block system of the present invention that are designed to meet these needs. The modular block system of the present invention is totally reusable. Make a mistake in construction. It can be taken down and re-assembled correctly, no waste. Want to add a room? The floor plan can be changed using the original parts. While the materials may not be 100% recycled content, the structural blocks of the present invention are one hundred percent (100%) reusable, unlike any other building system currently on the market. The minimal energy and resources required to install/assemble the structural block system of the present invention is also an advantage in this market.

In summary, the present invention achieves these and other objectives by providing a reusable, energy-efficient modular block system. The reusable modular block system includes a lightweight, high-performance structural block having an insulating core, an inside facing and an outside facing, a gasketing system connected to the structural block, and a fastening system within the insulating core that extends horizontally and vertically through the insulating block and connects both vertically and horizontally to the adjoining blocks. It is easy to store and install. Other aspects of the present invention include compliance with all applicable building codes and standards; in addition, it provides a means of securing the components together, to accessory building components, and to the foundation. It is easy to store and install.

DETAILED DESCRIPTION OF THE PREFERRED EMBODIMENT

Figure 1:
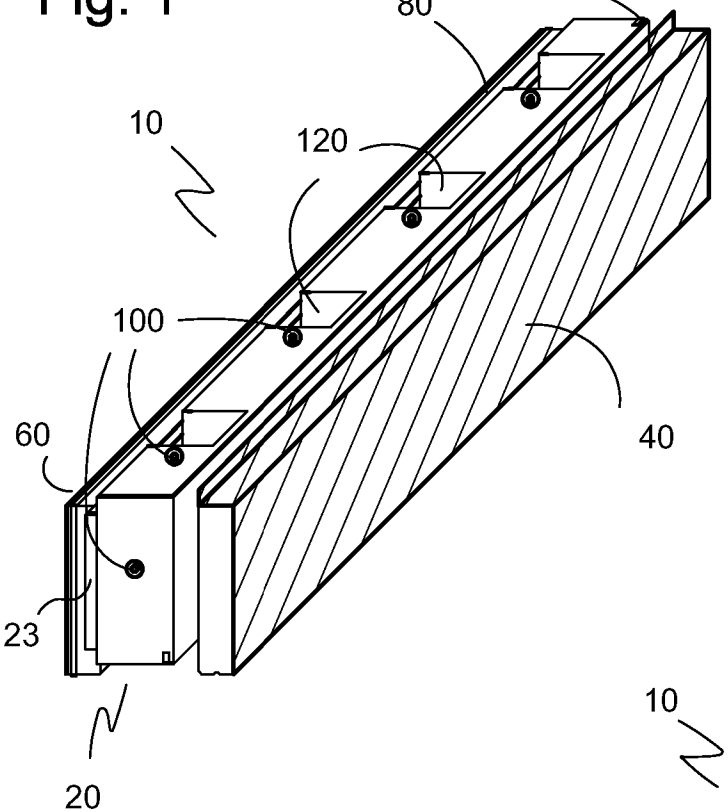
FIG. 1 is a perspective view of one embodiment of the present invention showing a horizontal structural block.

The preferred embodiment(s) of the present invention is illustrated in FIGS. 1-19. FIG. 1 shows a structural block 10 of the structural block system of the present invention. Structural block 10 includes an insulating core 20 with a shoulder 23, an outside facing 40 (this may optionally wrap around the two ends), an inside facing 60, a gasketing system 80, a fastening system 100, and one or more optional tubular openings 120. Insulating core 20 is an insulating core material, preferably a closed-cell foam and, more preferably, a two-part closed-cell foam. Examples of acceptable closed-cell foams are polyurethane, polystyrene, foam glass, and the like. Outside facing 40 and inside facing 60 are preferably made of a code-compliant fire protection material such as, for example, a metal or other fire-retardant cladding. Outside and inside facings 40, 60 are preferably about 0.030 inches (0.76 mm) thick and are connected to insulating core 20. Various conventional methods may be used for attaching the facings 40, 60 to insulating core 20 such as mechanical, mold-injecting, adhesive, and other bonding techniques known to those skilled in the relevant art.

Figure 2:
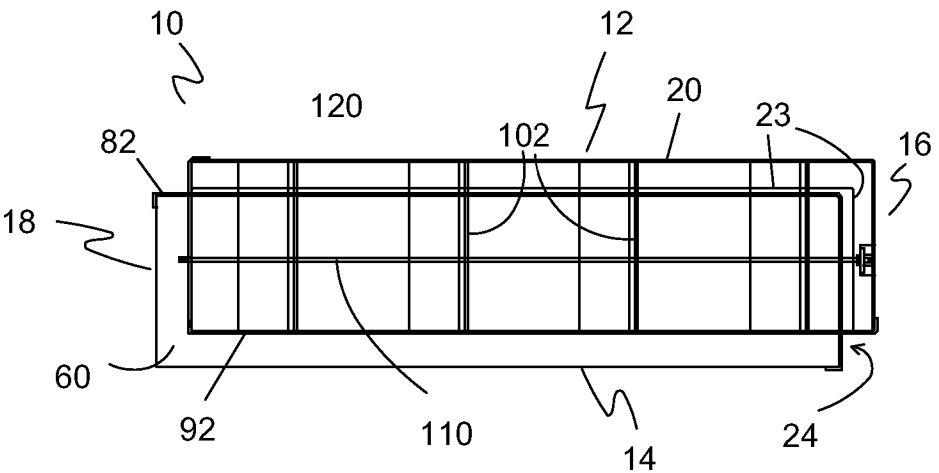
FIG. 2 is a side transparent view of the embodiment in FIG. 1 showing the inside facing, the shoulder, and the protruding edge of the central portion.

FIG. 2 is a side, transparent view of structural block 10 showing the inside facing 60. Shoulder 23 extends a predefined distance above the top of inside facing 60 and beyond the end of inside facing 60 at a first block end 16. Shoulder 23 is instrumental in forming internal raceways, which will be more clearly disclosed and explained later. Insulating core 20 extends above a block top 12 and beyond first block end 16. As can be seen from the side view, a recess channel 24 extends the length of a block bottom 14 and a second block end 18. Recess channel 24 is more clearly illustrated in the remaining figures.

Gasketing system 80 includes an inside gasket 82 and an outside gasket 92. As illustrated, inside gasket 82 and outside gasket 92 are configured along two sides of structural block 10. Inside gasket 82 is connected along a pre-selected surface of block top 12 and first block end 16 while outside gasket 92 is connected along a pre-selected surface of block bottom 14 and second block end 18. When two adjacent structural blocks 10 are connected to each other, gasketing system 80 creates a weather tight seal spaced from the inside facing 60 and outside facing 40 around the periphery of structural block 10. It should be understood that the gasket material may optionally surround the periphery of structural block 10 on all sides, but this only adds cost to the block without any noticeable improvement in system performance. The gasket material is preferably a resilient material that retains its ability to provide a seal even when the structural blocks are disassembled and reassembled.

Fastening system 100 typically includes at least one vertical connecting mechanism 102 and at least one horizontal connecting mechanism 110 for each structural block 10; although in some limited block components of the present invention, there may be only a vertical connecting mechanism, a horizontal mechanism, or no component of fastening system 100 whatsoever. The structural block illustrated is one example of structural block 10 having a length of 4 feet (1.22 m) and a height of 1 foot (30.5 cm). As previously explained, structural block 10 may be provided in various lengths and heights, but preferable in commonly used multiples of sizes typical of the building trade. For example, structural blocks 10 could be provided in 1 foot (30.5 cm) or ½ foot (15.25 cm) increments in either the length or height dimensions, or both. It is further noted that the width of structural block 10 could vary as well depending on R-value or other structural reasons.

Figure 3:
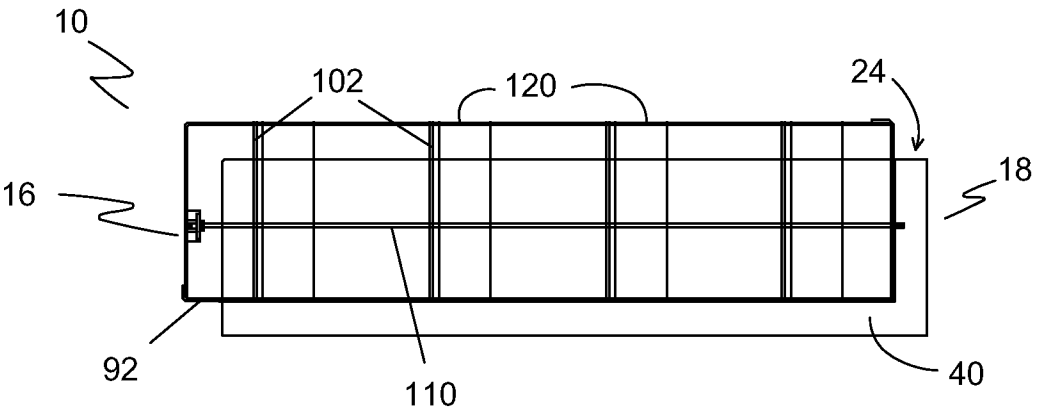
FIG. 3 is a side transparent view of the embodiment in FIG. 1 showing the outside facing and the protruding edge of the central portion.

FIG. 3 is a transparent side view of structural block 10 showing the outside facing 40. Insulating core 20 extends along top 12 and first block end 16 while recess 24 extends along bottom 14 and second block end 18, which creates a male-female interlocking mechanism for assembling a plurality of modular blocks 10 of the present invention. A plurality of vertical and horizontal connecting mechanisms 102, 110 are within insulating core 20.

Figure 4:
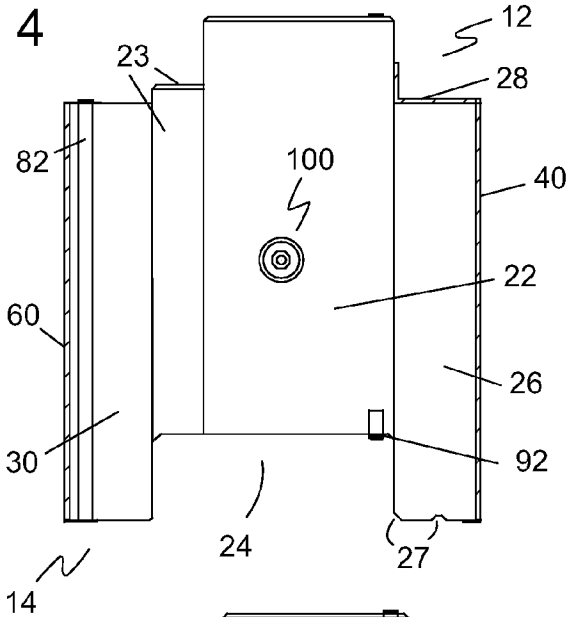
FIG. 4 is an end view of the embodiment in FIG. 1 showing the first block end with the end shoulder and the protruding end edge of the central portion.

Turning now to FIG. 4, there is illustrated an end view of first block end 16. Insulating core 20 has a central portion 22, an outside portion 26, and an inside portion 30. Central portion 22 has a shoulder 23 that extends a predefined distance above the top of inside portion 30 and extends beyond first block end 16 such that it is extending toward the viewer of FIG. 4. Recess channel 24 along bottom 14 is illustrated. Inside gasket 82 is connected to the inside portion 30 of insulating core 20 and spaced from inside facing 60. Outside portion 26 includes optional capillary break structures 27. Outside facing 40 has an optional flashing extension 28 that extends over the top of outside portion 26 and up a predefined distance along the extension of central portion 22. As can be seen, outside gasket 92 does not extend over the entire length of first block end 16 of insulating core 20. It should be noted that the preferred embodiment illustrates the inside facing 60 and the outside facing 40 as optionally wrapping around the top 12 and the bottom 14. It also shows that this wrapping of the facings is not necessary.

Figure 5:
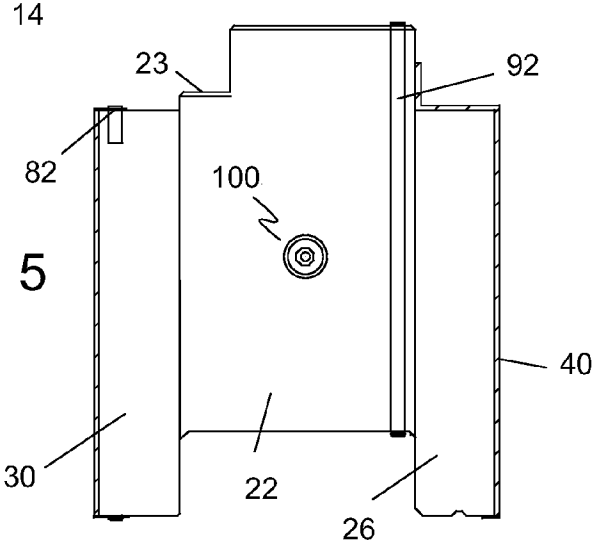
FIG. 5 is an end view of the embodiment of FIG. 1 showing the second block end having the recessed channel.

FIG. 5 shows an end view of second block end 18. Outside gasket 92 extends along the bottom of central portion 22 and up the end of central portion 22 at second block end 18 and spaced from outside portion 26. Recess channel 24 extends the entire length of central portion 22 at this second block end 18. Recess channel 24 and the extension of central portion 22 provide the interlocking mechanism in both the horizontal and vertical direction that makes assembly of the modular block system of the present invention easy and intuitive.

Figure 6:
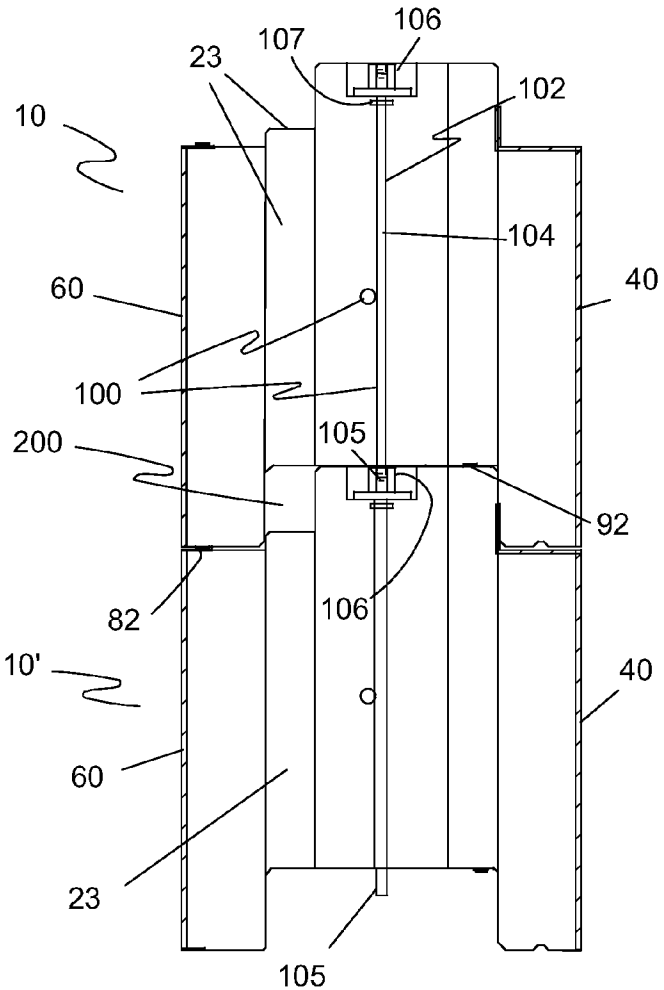
FIG. 6 is an end view of the embodiment in FIG. 1 showing the internal horizontal raceway created when two horizontal blocks are assembled.

FIG. 6 is a cross-sectional view of two structural blocks 10, 10' assembled to each other as viewed from first block end 16. It should be noted that the method of assembly does not require the vertical junctions of blocks 10, 10' to be staggered because of fastening system 100 and the interlocking features of blocks 10. The extension of central portion 22' and shoulder 23' of the lower block 10' mate with recess channel 24 of the upper block 10. Vertical connecting mechanism 102 extends through the central portion 22 of insulating core 20 from top 12 to bottom 14.

In the embodiment illustrated, vertical connecting mechanism 102 has an elongated member 104 with a fastener extending end 105 and a fastener receiving end 106. Fastener ends 105, 106 are matingly configured so that the fastener extending end 105 connectively attaches to the fastener receiving end 106' of a vertical connecting mechanism 102' in an adjacent block 10'. In this example, fastener extending end 105 has a predefined number of threads and fastener receiving end 106 has an outer structure shaped like a nut with a threaded internal recess. As the blocks 10, 10' and the connecting mechanisms 102, 102' are aligned, the fastener extending end 105 of the top block 10 is threaded into the fastener receiving end 106' of the bottom block 10' by turning fastener receiving end 106. As tensioning occurs, inside gasket 82 and outside gasket 86 are compressed between blocks 10, 10' creating a weather-tight seal. It should be understood that FIG. 6 illustrates the assembled blocks before tensioning in order to show the positions of the inside and outside gaskets 82, 86, respectively. FIG. 6 also illustrates an optional retaining member 107 connected to connecting mechanism 102. Retaining member 107 is retained by central portion 22 of foam block 20 to prevent accidental loss of connecting mechanism 102.

One of the key features of the modular block system of the present invention is the continuous, horizontal, internal raceway 200 created by the assembly of adjacent structural blocks 10. For each run of horizontal blocks 10, a horizontal raceway is formed by the central portion 22 and the inside portion 30. The surfaces that create raceway 200 may optionally be covered with an electrically conductive material for grounding purposes. As will be explained later, continuous, vertical, internal raceways are similarly created upon assembly.

Figure 7:
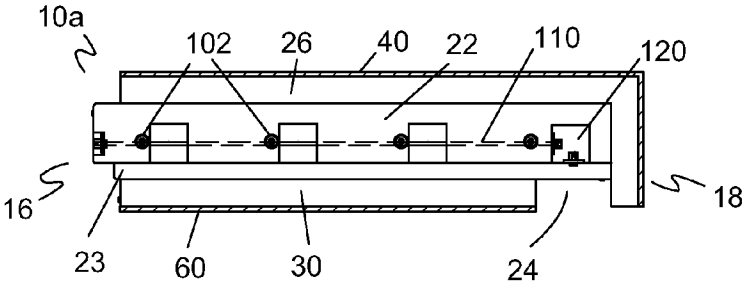
FIG. 7 is a top view of another embodiment of the present invention showing one embodiment of a corner block.

Turning now to FIG. 7, there is illustrated a top view of one embodiment of a corner block of the present invention. Like the horizontal block previously discussed, corner block 10*a* has central portion 22 with shoulder 23, outside portion 26, inside portion 30, outside facing 40, inside facing 60, first block end 16, second block end 18, vertical connecting mechanism 102, horizontal connecting mechanism 110, and tubular openings 120. Recess 24 at second block end 18 is substantially perpendicular to the central portion 22. Outside portion 26 and outside facing 40 wrap around second block end 18 forming an outside wall corner. As shown, tubular opening 120 at second block end 18 provides access to fastener receiving end 106 for tensioning horizontal connecting mechanism 110.

Figure 8:
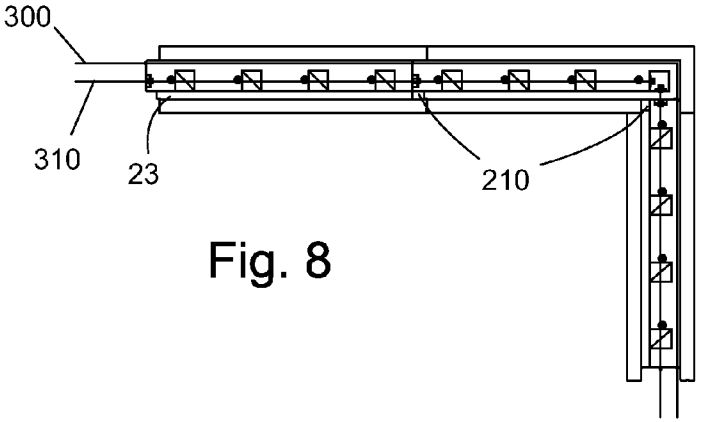
FIG. 8 is a top view of the embodiment in FIG. 7 showing the assembly of the corner block with two of the horizontal blocks shown in FIG. 1 and the vertical internal raceways at each interlock of the assembly of two structural blocks.

FIG. 8 illustrates the use of the embodiment of corner block 10*a* with horizontal blocks 10. Line 300 indicates the center line for outside gasket 92 and line 310 indicates the center line for horizontal connecting mechanism 110. First block end 16 connects with second block end 18 forming an internal, vertical raceway 210 at each junction between adjacent blocks.

Figure 9:
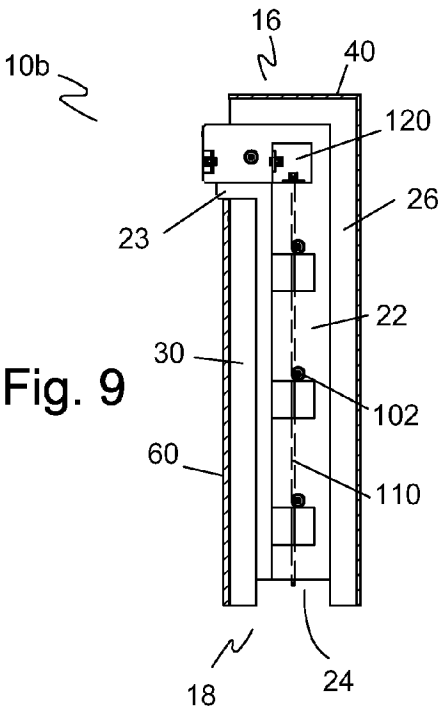
FIG. 9 is a top view of another embodiment of the present invention showing another embodiment of the corner block.

Turning now to FIG. 9, there is illustrated a top view of another embodiment of a corner block of the present invention. In this embodiment, corner block 10*b* has central portion 22 with shoulder 23, outside portion 26, inside portion 30, outside facing 40, inside facing 60, first block end 16, second block end 18, vertical connecting mechanism 102, horizontal connecting mechanism 110, and tubular openings 120. The extension of central portion 22 at first block end 16 is substantially perpendicular to the recess channel 24 at second block end 18. Outside portion 26 and outside facing 40 wrap around first block end 16 forming an outside wall corner. As shown, tubular opening 120 at first block end 16 provides access to fastener receiving end 106 for tensioning horizontal connecting mechanism 110.

Figure 10:
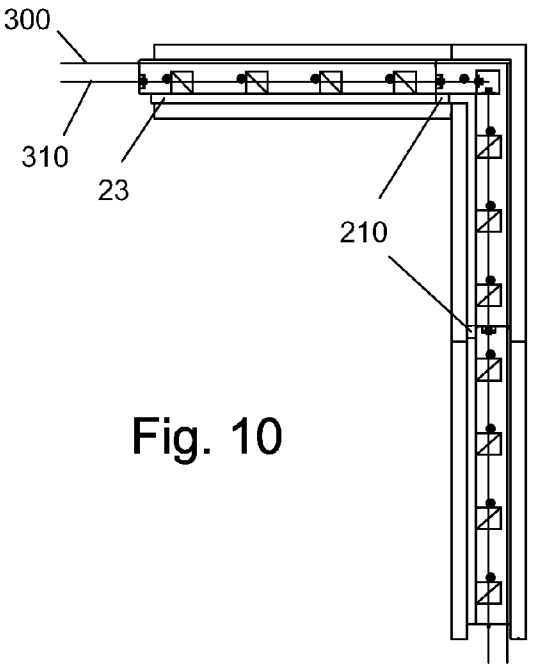
FIG. 10 is a top view of the embodiment in FIG. 9 showing the assembly of the corner block with two of the horizontal blocks shown in FIG. 1 and the vertical internal raceways at each interlock of the assembly of two structural blocks.

FIG. 10 illustrates the use of the embodiment of corner block 10*b* with horizontal blocks 10. Line 300 indicates the center line for outside gasket 92 and line 310 indicates the center line for horizontal connecting mechanism 110. First block end 16 connects with second block end 18 forming an internal, vertical raceway 210 at each junction between adjacent blocks.

Figure 11:
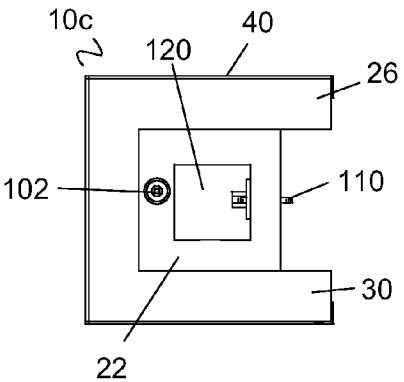
FIG. 11 is a top view of one embodiment of the present invention showing one embodiment of an end block.

FIG. 11 illustrates a top view of one embodiment of an end block 10*c*. End block 10*c* includes insulating core 20 having a central portion 22 with tubular opening 120, and vertical and horizontal connecting mechanisms 102, 110, respectively. The facing may be either outside facing 40, inside facing 60, or both depending on the use of the end block. It should be also understood that any of the structural blocks of the present invention may have the same facing material on both sides of the structural blocks, i.e., inside facing or outside facing, depending on where the wall is being located. A narrower end block is also contemplated that would not have a central portion 22.

Figure 13:
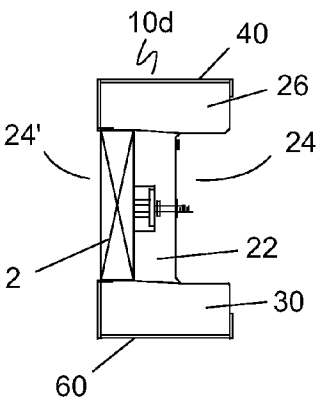
FIG. 13 is an end view of the side jamb block in FIG. 12 showing one of the recessed channels containing a piece of conventional lumber installed in the recess provided in the jamb block.
Figure 12:
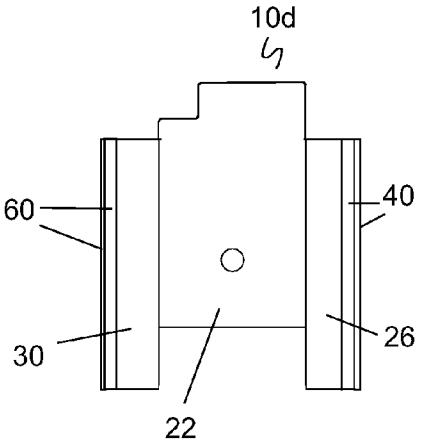
FIG. 12 is a side view of one embodiment of the present invention showing a side jamb block.

FIGS. 12 and 13 illustrate one embodiment of a side jamb block 10*d*. FIG. 12 shows a side view of one embodiment of a side jamb block 10*d* with central portion 22, outside portion 26, inside portion 30, outside facing 40, and inside facing 60. FIG. 13 is a top end view of side jamb block 10*d* showing insulating core 20 with recess channel 24 and 24' on either side of central portion 22 between inside portion 26 and outside portion 30. In one of the recess channels 24, 24', a piece of convention lumber 2 may be connected to provide a surface for attachment of an accessory door or window unit. Side jamb block 10*d* may optionally be provided as left or right side jambs for doors or with the same or different inside facings for indoor use.

Figure 14:
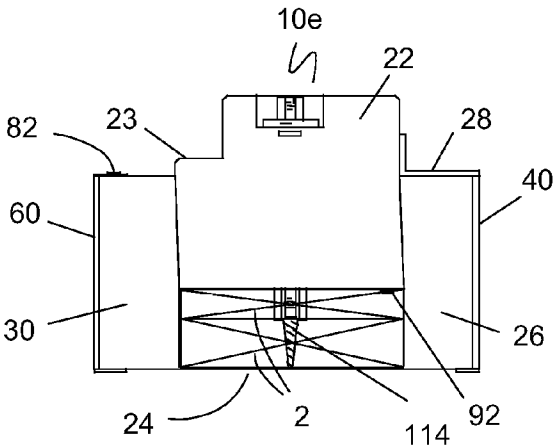
FIG. 14 is an end view of another embodiment of the present invention showing a head cap block with optional conventional lumber.

FIG. 14 illustrates an end view of one embodiment of a head cap block 10*e*. Like previous structural blocks, head cap block 10*e* has an insulating core 20 with central portion 22, outside portion 26 and inside portion 30. Outside facing 40 is attached to outside portion 26 and inside facing 60 is attached to inside portion 30. Shoulder 23 of central portion 22 is adjacent inside portion 30 and insulating core 20 has gasketing system 80 connected thereto. In this embodiment, outside gasket 92 seals head cap block 10*e* to the wood. In this way, the wood is sealed to the window/door as in conventional construction for air barrier continuity. Recess channel 24 may optionally contain conventional lumber 2 held in place by a cap fastener 114, which may be the same or similar to a sill cap fastener 115 disclosed below.

Figure 15:
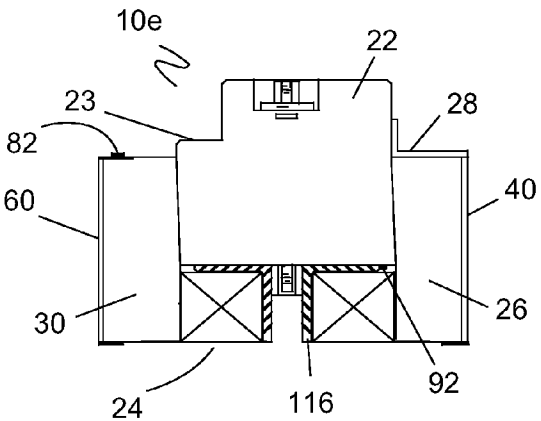
FIG. 15 is an end view of another embodiment of the present invention showing a head cap block with an optional concentrated load support member and optional conventional lumber installed in the recess provided in the head cap block.

FIG. 15 illustrates the embodiment in FIG. 14 but with an additional, optional member. Within recess channel 24, there is illustrated a concentrated load support member 116. Load support member 116 is a reinforcing structural lintel section (preferably two angled components as shown) that provides additional load-bearing support to the structural blocks. Load support member 116 preferably attaches to the vertical connecting mechanism in a similar way that one connecting mechanism attaches to another connecting mechanism.

Figure 18:
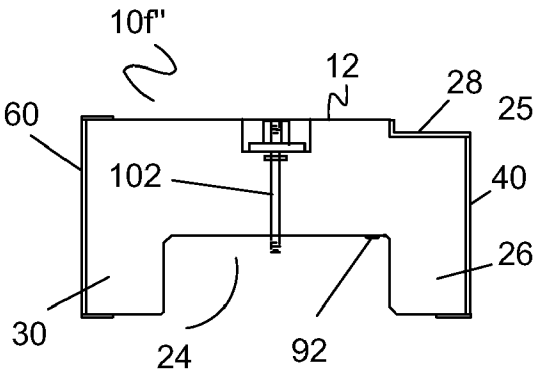
FIG. 18 is an end view of another embodiment of the flush sill cap block in FIG. 16.
Figure 17:
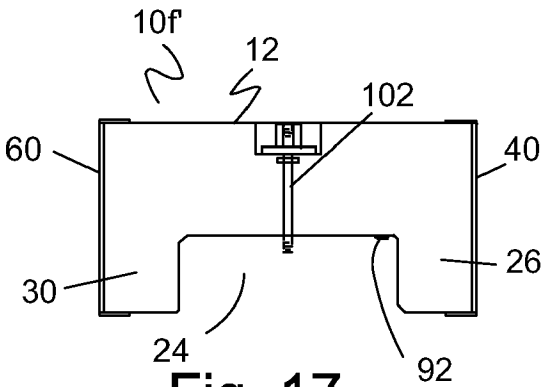
FIG. 17 is an end view of another embodiment of the flush sill cap block in FIG. 16.
Figure 16:
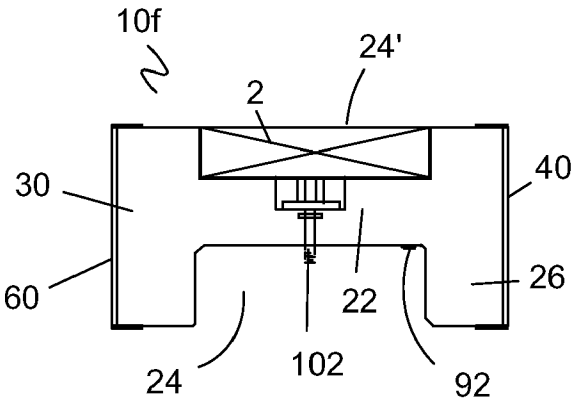
FIG. 16 is an end view of another embodiment of the present invention showing one embodiment of a sill cap block with optional conventional lumber installed in the recess provided in the sill cap block.

FIGS. 16-18 illustrate various embodiments of a sill cap block 10*f*. FIG. 16 is an end view of sill cap block 10*f* showing an insulating core 20 with an outside facing 40 and an inside facing 60. Because it is used as a sill cap, sill cap block 10*f* has only an outside gasket 92. In shape, the embodiment of sill cap block 10*f* is similar in profile to side jamb block 10*d*. Sill cap block 10*f* has a central portion 22, an outside portion 26, an inside portion 30, and recess channels 24, 24' on either side of central portion 22 between outside portion 26 and inside portion 30. In this configuration, a piece of convention lumber 2 in inserted within recess channel 24' in order to provide a flat surface for receiving the bottom of a window. FIG. 17 illustrates another embodiment of a sill cap 10*f'*. In this embodiment, sill cap 10*f'* has only one recess channel 24 and a top 12 that is substantially flat over its entire top surface without any part of central portion 22 extending beyond top 12 (these flat versions are for windows that are set farther inward in the block section where the top of the block shows outside beyond the window sill). FIG. 18 illustrates another embodiment of a sill cap. In this embodiment, sill cap 10*f''* has one recess channel 24 and a top 12 that is substantially flat over a major portion of its top surface. A recessed shoulder 25 is created along the top outside portion 26 of insulating core 20. Outside facing 40 preferably has an optional flashing extension 28 that covers recessed shoulder 25. Flashing extension 28 provides flashing for water running off of the sill, which is set back (inward) on block 10.

Figure 19:
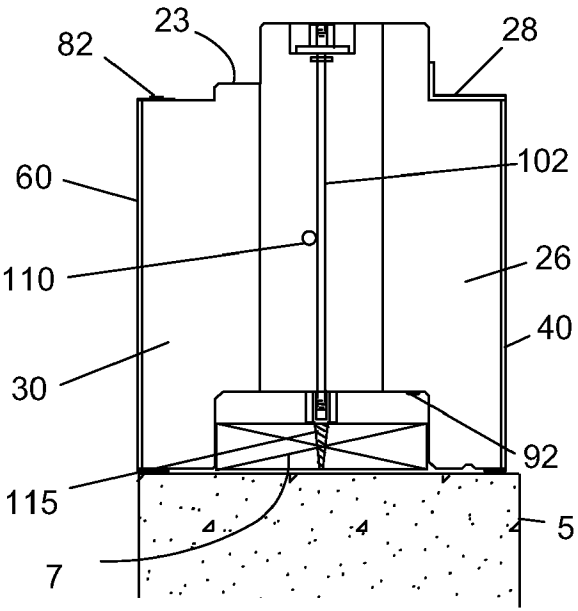
FIG. 19 is an end view of the embodiment in FIG. 1 showing its use as a base block with a base sill fastener with optional conventional lumber installed in the interlock.

FIG. 19 illustrates the interface between a structural block 10 of the present invention and a base such as a foundation 5. All conventional foundations have a sill board 7 installed on the top surface of the foundation 5. The sill board 7 is typically pressure-treated lumber that is secured in place with securing straps or anchor bolts (not shown) that are anchored in the concrete of the foundation. A structural block 10 that is used as the starter blocks on a base/foundation requires a means for securing the block 10 to the foundation. Alternately, a similar wood sill board would be attached to a wood floor deck or platform. A base sill fastener 115 is configured for attachment to the connecting mechanism 102 of a block 10 at fastener extending end 105. Base sill fastener 115 has a threaded recess on one end for receiving fastener extending end 105 and a mechanism for attaching to the sill board. In the illustration in FIG. 19, the mechanism for attaching to the sill board 7 is a screw configuration that screws into the sill board 7 to anchor structural block 10 to the base/foundation 5.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A reusable modular block system comprising:

a lightweight structural block having a top, a bottom, a first block end, a second block end, an insulating core made of a lightweight, insulating material and including a central portion, a shoulder portion, an inside portion, and an outside portion, wherein the central portion extends a predefined distance beyond the top and the first block end and has a recessed channel along the bottom and the second block end, wherein the depth of the recessed channel is equal to or less than the predefined distance of the central portion, the shoulder portion extending vertically to a space between the inside portion and the central portion, and horizontally to a space between the first block end and the inside portion, and further extending along the length of the top and the first block wherein the shoulder portion forms internal horizontal raceways between the shoulder portion of one structural block and the recessed channel of an adjacent block, and internal vertical raceways between the shoulder portion of one structural block and the central and inside portions of an adjacent block the recessed shoulder being positioned closer to the inside facing than the outside facing;

a gasketing system connected to the structural block along a portion of the periphery of the structural block wherein the gasketing system forms a weathertight seal between adjacent structural blocks; and a fastening system having at least one vertical connecting mechanism that is an elongated member with external threads on one end and internal threads on the opposite end positioned within the insulating core and extending between the top and the bottom and at least one lateral connecting mechanism that is an elongated member with external threads on one end and internal threads on the opposite end positioned within the insulating core and extending between the first end and the second end wherein the structural block, the gasketing system and the fastening system form a single, integral block component.

2. The modular block system of claim 1 wherein the gasketing system has an inside gasket along at least a portion of the periphery of the insulating core adjacent to and spaced from the inside facing and an outside gasket along at least a portion of the periphery of the insulating core adjacent to and spaced from the outside portion.

3. The modular block system of claim 2 wherein the inside gasket is located on at least a top surface of the insulating core and a side surface of the first block end.

4. The modular block system of claim 2 wherein the outside gasket is located on at least a bottom surface of the insulating core and a side surface of the second block end.

5. The modular block system of claim 1 wherein the structural block has one or more tubular openings that extend from the top to the bottom.

6. The modular block system of claim 1 wherein the elongated member has a retaining member captively retained by the central portion of the insulating core.

7. The modular block system of claim 1 wherein the system further includes a corner block with the gasketing system and the fastening system wherein the corner block is selected from a modular block having the first end and a portion of the outside facing and not the inside facing substantially perpendicular to the insulating core and a modular block having the second end and a portion of the outside facing and not the inside facing substantially perpendicular to the insulating core.

8. The modular block system of claim 7 further comprising a base sill fastener connected to the at least one vertical connecting mechanism at a bottom end wherein the base sill fastener is configured to couple the fastening system to a wood foundation sill or supporting deck.

9. The modular block system of claim 7 further comprising a concentrated load support member comprising at least one elongated member configured for supporting placement within the recessed channel of one or more connected horizontal blocks, sill cap blocks, and head cap blocks.

10. The modular block system of claim 7 wherein the sill cap block has the central portion co-planar with the top of the sill cap block.

11. The modular block system of claim 7 wherein the sill cap block has a recessed channel in the top sized to receive conventional lumber.

12. The modular block system of claim 7 wherein the sill cap block has a recessed shoulder along the length of the top of an outside portion of the sill cap block.

13. The modular block system of claim 1 wherein the insulating core has one or more capillary break structures longitudinally extending along the bottom of an outside portion of the insulating core.

14. The modular block system of claim 1 wherein the outside facing extends over a top of an outside portion of the insulating core and up along a portion of a side of the central portion.

15. The modular block system of claim 1 wherein the system further includes a sill cap block with the gasketing system and the fastening system wherein the sill cap block has a flat top coextensive with the outside facing and the inside facing and a recessed bottom wherein the flat top forms a window sill for receiving a window.

16. The modular block system of claim 1 wherein the system further includes a head cap block with the gasketing system and the fastening system wherein the head cap block has the bottom with the recessed channel configured for receiving a concentrated load support member forming a flat bottom and where the flat bottom forms the top of a window opening or a door opening.

17. The modular block system of claim 1 further comprising a side jamb block with the gasketing system and the fastening system wherein the side jamb block has the top with a predefined central core extension, the bottom and the second end with the recessed channel, and the first end without the predefined central core extension where the side jamb block forms a window or a door side jamb.

18. The modular block system of claim 1 further comprising an end block with the gasketing system and the fastening system wherein the end block has the first end without a predefined central core extension and wherein the outside facing extends to cover the first end.

* * * * *